US011276520B2

(12) United States Patent
Choi et al.

(10) Patent No.: US 11,276,520 B2
(45) Date of Patent: Mar. 15, 2022

(54) MULTILAYER SEED PATTERN INDUCTOR, MANUFACTURING METHOD THEREOF, AND BOARD HAVING THE SAME

(71) Applicant: SAMSUNG ELECTRO-MECHANICS CO., LTD., Suwon-si (KR)

(72) Inventors: Woon Chui Choi, Suwon-Si (KR); Ji Hye Oh, Suwon-Si (KR); Hye Min Bang, Suwon-Si (KR); Myung Jun Park, Suwon-Si (KR); Jung Hyuk Jung, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 562 days.

(21) Appl. No.: 16/200,263

(22) Filed: Nov. 26, 2018

(65) Prior Publication Data

US 2019/0096563 A1 Mar. 28, 2019

Related U.S. Application Data

(63) Continuation of application No. 14/849,365, filed on Sep. 9, 2015, now Pat. No. 10,388,447.

(30) Foreign Application Priority Data

Sep. 22, 2014 (KR) ..... 10-2014-0126205

(51) Int. Cl.
*H01F 27/28* (2006.01)
*H01F 27/255* (2006.01)
(Continued)

(52) U.S. Cl.
CPC ..... *H01F 27/255* (2013.01); *H01F 5/00* (2013.01); *H01F 17/0013* (2013.01);
(Continued)

(58) Field of Classification Search
CPC ..... H01F 27/255; H01F 5/00; H01F 17/0013; H01F 17/04; H01F 41/043; H01F 41/046;
(Continued)

(56) References Cited

U.S. PATENT DOCUMENTS 7,176,773 B2 2/2007 Shoji
2004/0164835 A1 8/2004 Shoji
(Continued)

FOREIGN PATENT DOCUMENTS

CN 1523617 A 8/2004
CN 103695972 A 4/2014
(Continued)

OTHER PUBLICATIONS

Office Action issued in Chinese Application No. 201810203116.3 dated Sep. 2, 2019, with English translation.
(Continued)

*Primary Examiner* — Tuyen T Nguyen
(74) *Attorney, Agent, or Firm* — Morgan, Lewis & Bockius LLP

(57) ABSTRACT

A multilayer seed pattern inductor includes: a magnetic body containing a magnetic material; and an internal coil part encapsulated in the magnetic body, wherein the internal coil part includes a seed pattern and a surface plating layer disposed on the seed pattern, the seed pattern being formed as two or more layers.

20 Claims, 12 Drawing Sheets

I-I'

(51) Int. Cl.

| | |
|---|---|
| ***H01F 5/00*** | (2006.01) |
| ***H01F 17/00*** | (2006.01) |
| ***H01F 17/04*** | (2006.01) |
| ***H01F 41/04*** | (2006.01) |
| *H01F 27/29* | (2006.01) |

(52) U.S. Cl.
CPC ..... *H01F 17/04* (2013.01); *H01F 27/28* (2013.01); *H01F 41/043* (2013.01); *H01F 41/046* (2013.01); *H01F 27/292* (2013.01); *H01F 2017/048* (2013.01)

(58) Field of Classification Search
CPC ..... H01F 27/292; H01F 2017/048; H01F 27/2804; H01F 41/041; H05K 1/182
See application file for complete search history.

(56) References Cited

U.S. PATENT DOCUMENTS

| | | | |
|---|---|---|---|
| 2007/0126543 | A1 | 6/2007 | Yeh et al. |
| 2013/0300527 | A1 | 11/2013 | Kim et al. |
| 2014/0001397 | A1 | 1/2014 | Park et al. |
| 2014/0247101 | A1 | 9/2014 | Cha et al. |

FOREIGN PATENT DOCUMENTS

| | | | | |
|---|---|---|---|---|
| JP | S64-4091 | A | | 1/1989 |
| JP | 10-241983 | A | | 9/1998 |
| JP | H11-204337 | A | | 7/1999 |
| JP | H11-204361 | A | | 7/1999 |
| JP | 2001-267166 | A | | 9/2001 |
| JP | 2001267166 | A | * | 9/2001 |
| JP | 2002-280219 | A | | 9/2002 |
| JP | 2004-128130 | A | | 4/2004 |
| JP | 2004-253684 | A | | 9/2004 |
| JP | 2006-278479 | A | | 10/2006 |
| JP | 2009-10268 | A | | 1/2009 |
| JP | 2014-011467 | A | | 1/2014 |
| JP | 2014-080674 | A | | 5/2014 |
| JP | 2014-170924 | A | | 9/2014 |
| KR | 10-2013-0125105 | A | | 11/2013 |

OTHER PUBLICATIONS

Office Action issued in corresponding Japanese Patent Application No. 2017-240070 dated Apr. 2, 2019, with English translation.
Office Action issued in Japanese Patent Application No. 2015-166452 dated Sep. 3, 2019, with English translation.
Japanese Office Action issued in Japanese Application No. 2015-166452, dated Nov. 8, 2016, with English Translation.
Chinese Office Action dated Jan. 25, 2017 issued in Chinese Patent Application No. 201510564663.0 (with English translation).
Korean Office Action issued in Application No. 10-2014-0126205 dated Jul. 9, 2015; with English translation.
Non-Final Office Action issued in U.S. Appl. No. 14/849,365, dated Mar. 14, 2018.
Non-Final Office Action issued in U.S. Appl. No. 14/849,365, dated Aug. 16, 2018.

* cited by examiner

I-I'

'A'

20
45'

71
20
25'

71
61

61

62

55'
41
42

30

50

MULTILAYER SEED PATTERN INDUCTOR, MANUFACTURING METHOD THEREOF, AND BOARD HAVING THE SAME

CROSS-REFERENCE TO RELATED APPLICATION

This application a Continuation of U.S. patent application Ser. No. 14/849,365, filed on Sep. 9, 2015, which in turn claims the priority and benefit of Korean Patent Application No. 10-2014-0126205 filed on Sep. 22, 2014, with the Korean Intellectual Property Office, the disclosure of which applications are incorporated herein by reference.

BACKGROUND

The present inventive concept relates to a multilayer seed pattern inductor, a manufacturing method thereof, and a board having the same.

Chip electronic components, such as inductors, are representative passive elements configuring electronic circuits together with resistors and capacitors, to remove noise therefrom.

A thin film type inductor is manufactured by manufacturing a magnetic body by forming internal coil parts therein through a plating process and then hardening a magnetic powder-resin composite containing a mixture of magnetic powder and a resin, and forming external electrodes on outer surfaces of the magnetic body, respectively.

RELATED ART DOCUMENTS

Japanese Patent Laid-Open Publication No. 2006-278479.
Japanese Patent Laid-Open Publication No. 1998-241983.

SUMMARY

An aspect of the present inventive concept provides a multilayer seed pattern inductor exhibiting a relatively low level of direct current (DC) resistance (Rdc) through a cross section of an internal coil part having increased area, a manufacturing method thereof, and a board having the same.

According to an aspect of the present inventive concept, a seed pattern may be formed as two or more layers, and a surface plating layer may be formed on the seed pattern.

BRIEF DESCRIPTION OF DRAWINGS

The above and other aspects, features and other advantages of the present inventive concept will be more clearly understood from the following detailed description taken in conjunction with the accompanying drawings.

DETAILED DESCRIPTION

Figure 1:
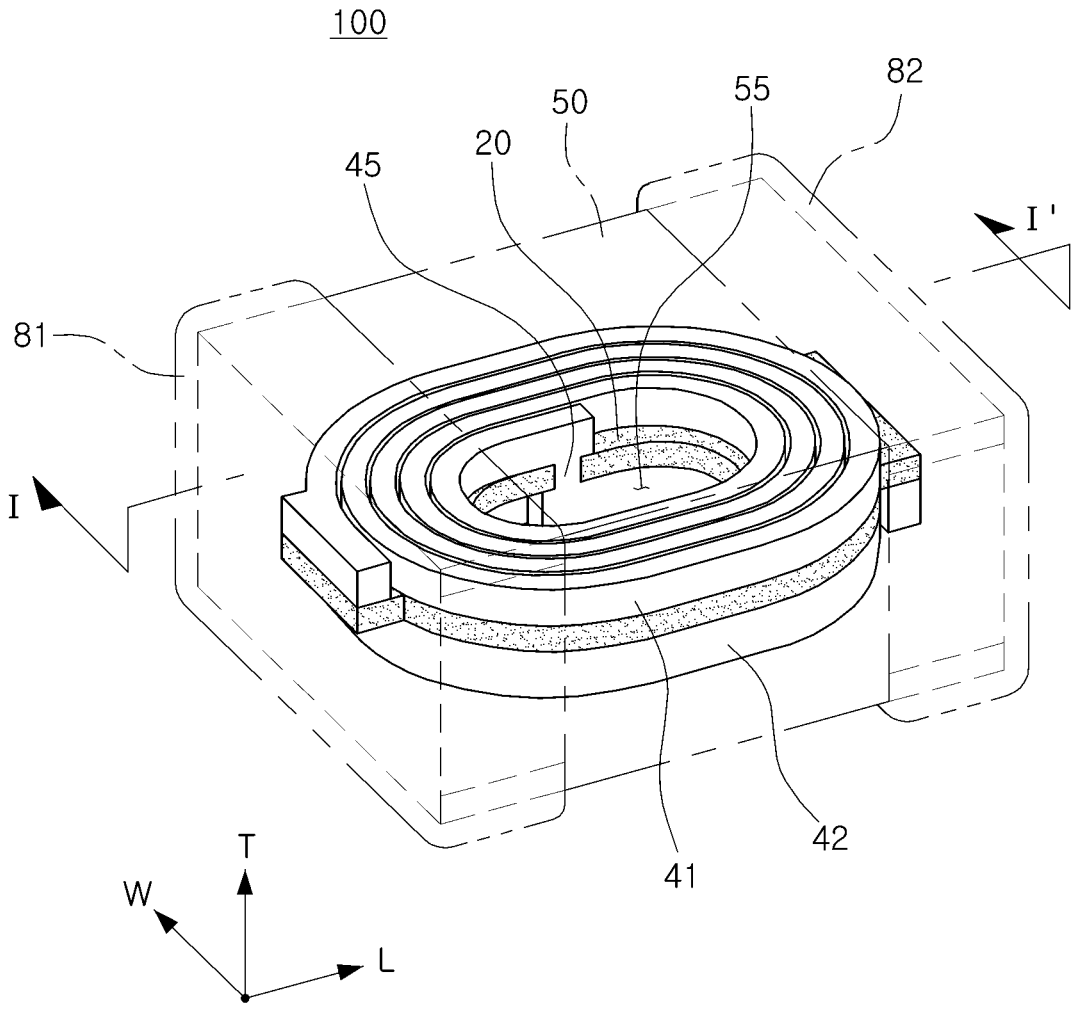
FIG. 1 is a schematic perspective view illustrating a multilayer seed pattern inductor according to an exemplary embodiment of the present inventive concept in which internal coil parts of the multilayer seed pattern inductor are visible.

Exemplary embodiments of the present inventive concept will now be described in detail with reference to the accompanying drawings.

The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

Further, in the drawings, for the increased clarity of the present inventive concept, a portion of the drawing irrelevant to a corresponding description will be omitted, for the clear illustration of several layers and areas, views of enlarged portions thereof will be provided, and elements having the same functions within the same scope of the inventive concept will be designated by the same reference numerals.

As used herein, it will be further understood that the terms "include" and/or "have" when used in the present inventive concept, specify the presence of elements, but do not preclude the presence or addition of one or more other elements, unless otherwise indicated.

Multilayer Seed Pattern Inductor

FIG. 1 is a schematic perspective view illustrating a multilayer seed pattern inductor according to an exemplary embodiment of the present inventive concept in which internal coil parts of the multilayer seed pattern inductor are visible.

Referring to FIG. 1, a thin film type inductor used in a power line of a power supply circuit is disclosed as an example of a multilayer seed pattern inductor 100.

A multilayer seed pattern inductor 100 according to an exemplary embodiment of the present inventive concept may include a magnetic body 50, first and second internal coil parts 41 and 42 encapsulated in the magnetic body 50, and first and second external electrodes 81 and 82 disposed on outer surfaces of the magnetic body 50 electrically connected to the first and second internal coil parts 41 and 42, respectively. In some embodiments, the first and second external electrodes 81 and 82 are in direct, physical contact with the first and second internal coil parts 41 and 42, respectively.

In the multilayer seed pattern inductor 100 according to the exemplary embodiment of the present inventive concept, a length direction refers to an 'L' direction of FIG. 1, a width direction refers to a 'W' direction of FIG. 1, and a thickness direction refers to a 'T' direction of FIG. 1.

The magnetic body 50 may form an outer casing of the multilayer seed pattern inductor 100 and may be formed of any material that exhibits magnetic properties without being particularly limited thereto. For example, the magnetic body 50 may be formed by filling ferrite or magnetic metal powder therein.

Such ferrite may be formed of, for example, manganese-zinc (Mn—Zn) based ferrite, nickel-zinc (Ni—Zn) based ferrite, nickel-zinc-copper (Ni—Zn—Cu) based ferrite, manganese-magnesium (Mn—Mg) based ferrite, barium (Ba) based ferrite, lithium (Li) based ferrite, or the like.

Such magnetic metal powder may contain any one or more selected from the group consisting of iron (Fe), silicon (Si), chromium (Cr), aluminum (Al), and Ni. For example, the metal magnetic powder may be an iron-silicon-boron-chromium (Fe—Si—B—Cr) based amorphous metal, but is not necessarily limited thereto.

The magnetic metal powder may have a particle size in a range of about 0.1 to 30 micrometers (μm) and may be contained in a thermosetting resin, such as an epoxy resin, polyimide, or the like, in a form in which the metal magnetic powder is dispersed therein.

The first internal coil part 41 having a coil shape may be formed on one surface of an insulating substrate 20 disposed in the magnetic body 50, and the second internal coil part 42 having a coil shape may be formed on the other surface of the insulating surface 20 opposing the one surface of the insulating substrate 20.

The first and second internal coil parts 41 and 42 may be formed by electroplating.

The insulating substrate 20 may be, for example, a polypropylene glycol (PPG) substrate, a ferrite substrate, a metal based soft magnetic substrate, or the like.

The insulating substrate 20 may have a through-hole formed in a central portion thereof penetrating therethrough, wherein the through-hole may be filled with magnetic materials to form a core part 55. The core part 55 filled with the magnetic materials may be formed, whereby inductance (Ls) may be improved. The through-hole in the insulating substrate may correspond to openings in central portions of the first and second internal coil parts 41 and 42, and the magnetic materials may fill the openings in the first and second internal coil parts.

The first and second internal coil parts 41 and 42 may be formed in a spiral shape, and the first and second internal coil parts 41 and 42 formed on the one surface and the other surface of the insulating substrate 20, respectively, may be electrically connected to each other through a via 45 penetrating through the insulating substrate 20.

The first and second internal coil parts 41 and 42 and the via 45 may be formed of a metal having relatively excellent electrical conductivity, for example, silver (Ag), palladium (Pd), Al, Ni, titanium (Ti), gold (Au), Cu, platinum (Pt), an alloy thereof, or the like.

A level of direct current (DC) resistance (Rdc), one of the main characteristics of an inductor, may be reduced as a cross sectional area of the internal coil part is increased. In addition, a level of inductance of an inductor may be increased as an area of a magnetic material through which a magnetic flux passes is increased.

Therefore, in order to decrease the level of DC resistance (Rdc) and increase the level of inductance of the inductor, the cross sectional area of the internal coil part may need to be increased and the area of the magnetic material may need to be increased.

In order to increase the cross sectional area of the internal coil part, increasing a width of a coil and increasing a thickness of the coil may be done.

However, in the case of increasing the width of the coil, a risk of short-circuits that may occur between adjacent portions of the coil is significantly increased, the number of available turns of the coil is limited, and the area of the magnetic material is reduced, such that efficiency characteristics may be decreased, and a limitation may be placed on providing a relatively high inductance product.

Therefore, there is a need for an internal coil part having a structure in which a relatively high aspect ratio (AR) is obtained by increasing the thickness of the coil by a greater amount as compared to an amount of increase in the width of the coil.

The aspect ratio (AR) of the internal coil part refers to a value obtained by dividing the thickness of the coil by the width of the coil, and a relatively high aspect ratio (AR) may be obtained as the thickness of the coil is increased to be larger than an amount of an increase in the width of the coil.

On the other hand, according to a related art, when forming the internal coil part by using a pattern plating of a plating resist through exposure and development processes and then plating, the plating resist needs to be formed to be relatively thick in order to form a relatively thick. However, in this case, it may be difficult to increase the thickness of the coil due to an exposure process limitation in which exposure of a lower portion of the plating resist is not smoothly performed as the thickness of the plating resist is increased.

In addition, according to a related art, the plating resist needs to have a predetermined width or more in order to maintain a thickness thereof. However, since the width of the plating resist having been removed subsequent to the plating resist being removed is equal to an interval between adjacent portions of the coil, the interval between the adjacent portions of the coil may be increased, such that there has been a limitation in improving DC resistance (Rdc) characteristics and inductance (LS) characteristics.

Meanwhile, JP 1998-241983 discloses performing exposure and development processes to form a first resist pattern and then form a first plating conductor pattern, and then re-performing the exposure and development processes on the first resist pattern to form a second resist pattern and then form a second plating conductor pattern in order to solve the exposure limitation based on the thickness of the resist film.

However, in the case of forming the internal coil part by only performing the pattern plating as in the case of JP 1998-241983, there is a limitation in increasing the cross sectional area of the internal coil part, and the interval between the adjacent portions of the coil may be increased, such that it may be difficult to improve DC resistance (Rdc) characteristics and inductance (LS) characteristics.

In this regard, in an exemplary embodiment of the present inventive concept, the internal coil part having a relatively high aspect ratio (AR), having an increased cross sectional area, and having a relatively narrow interval between the adjacent portions of the coil while preventing occurrence of short-circuits between the adjacent portions of the coil may be provided by forming the seed pattern as two or more layers and forming a surface plating layer on the seed pattern.

A detailed structure and a manufacturing method of the first and second internal coil parts 41 and 42 according to the exemplary embodiment of the present inventive concept will be described below.

Figure 2:
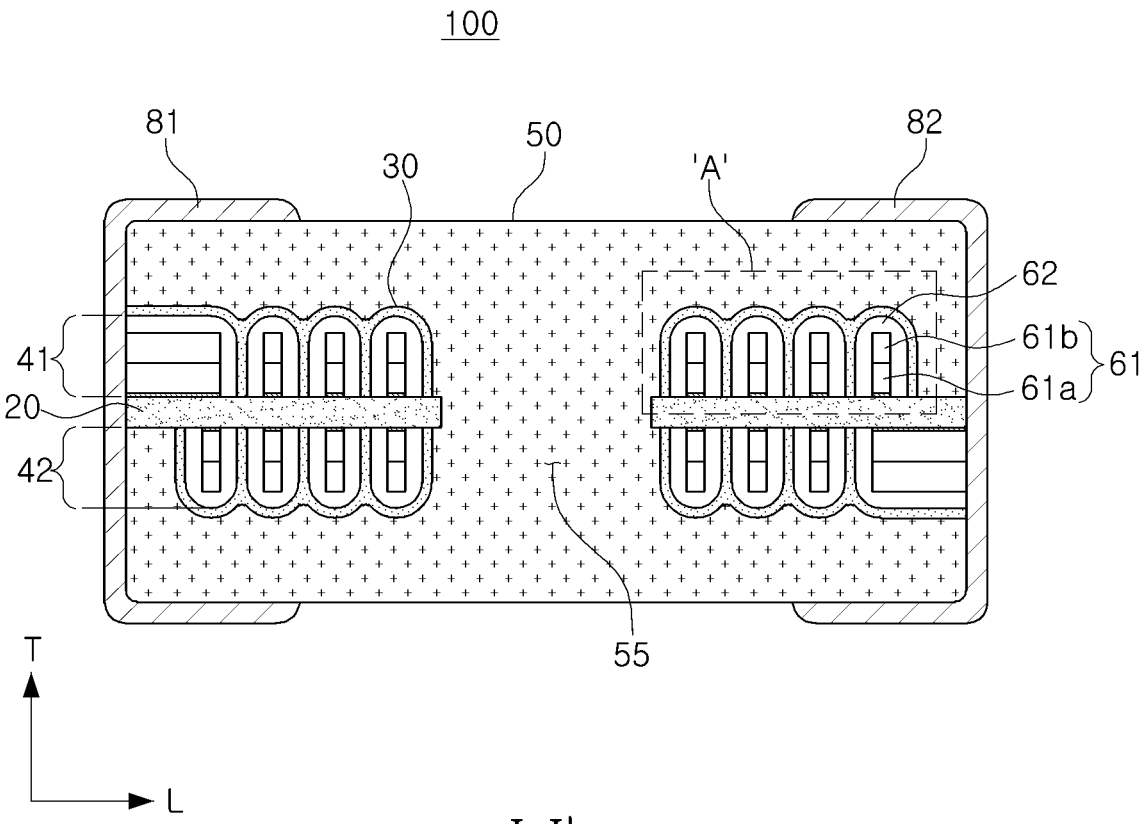
FIG. 2 is a cross-sectional view taken along line I-I' of FIG. 1.

FIG. 2 is a cross-sectional view taken along line I-I' of FIG. 1.

Referring to FIG. 2, the first and second internal coil parts 41 and 42 may include first seed patterns 61*a* formed on the insulating substrate 20, respectively, second seed patterns 61*b* formed on upper surfaces of the first seed patterns 61*a*, respectively, and surface plating layers 62 formed on the first and second seed patterns 61*a* and 61*b*, respectively.

The first and second internal coil parts 41 and 42 may be coated with insulating films 30, respectively.

The insulating film 30 may be formed by using a scheme well-known in the art such as a screen printing process, exposure and development processes on a photo-resist (PR), a spray applying process, or the like.

The first and second internal coil parts 41 and 42 may be coated with the insulating films 30, respectively, such that the insulating films 30 may not be in direct contact with a magnetic material forming the magnetic body 50.

One end portion of the first internal coil part 41 formed on one surface of the insulating substrate 20 may be exposed to one end surface of the magnetic body 50 in a length (L) direction of the magnetic body 50, and one end portion of the second internal coil part 42 formed on the other surface of the insulating substrate 20 may be exposed to the other end surface of the magnetic body 50 in the length (L) direction of the magnetic body 50.

However, the surfaces of the magnetic body 50 to which the first and second internal coil parts 41 and 42 are exposed are not necessarily limited thereto. For example, one end portion of each of the first and second internal coil parts 41 and 42 may be exposed to at least a surface of the magnetic body 50.

The first and second external electrodes 81 and 82 may be formed on outer surfaces of the magnetic body 50 to be connected to the first and second internal coil parts 41 and 42 exposed to the end surfaces of the magnetic body 50 in the length (L) direction of the magnetic body 50, respectively.

Figure 3:
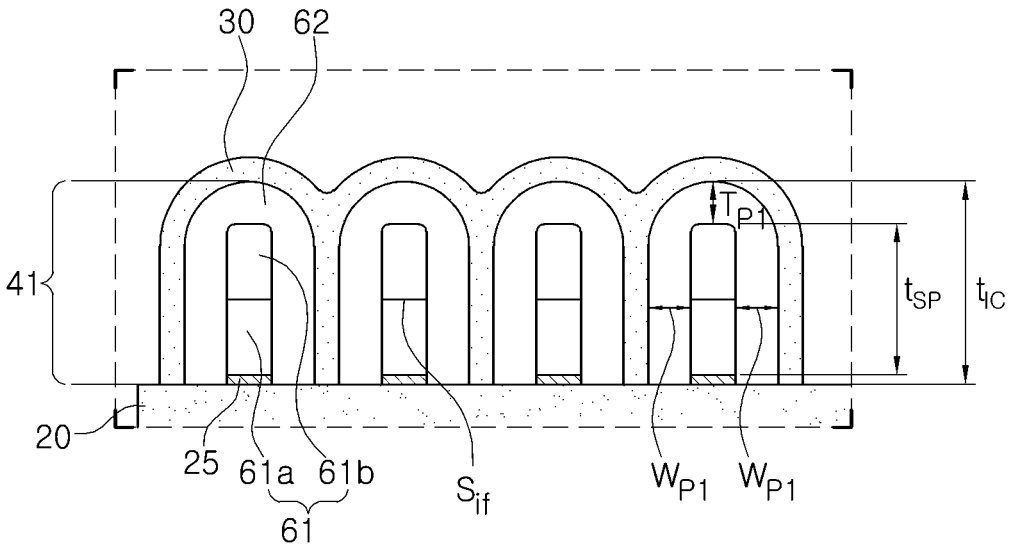
FIG. 3 is an enlarged schematic view of an exemplary embodiment of portion 'A' of FIG. 2.

FIG. 3 is an enlarged schematic view of an exemplary embodiment of portion 'A' of FIG. 2.

Referring to FIG. 3, a seed pattern 61 according to an exemplary embodiment of the present inventive concept may include the first seed pattern 61*a* and the second seed pattern 61*b* formed on the upper surface of the first seed pattern 61*a*, and may be coated with the surface plating layer 62.

The seed pattern 61 may be formed by a pattern plating scheme of forming a plating resist patterned through exposure and development processes on the insulating substrate 20 and filling an opening by plating.

The seed pattern 61 according to the exemplary embodiment of the present inventive concept may include at least one internal interface $S_{if}$ dividing the seed pattern into two or more layers. The internal interface $S_{if}$ of the seed pattern 61 may be formed between the first and second seed patterns 61*a* and 61*b*.

Although the seed pattern 61 is illustrated as two layers including the first and second seed patterns 61*a* and 61*b* in FIG. 3, the number of layers to be included in the seed pattern 61 is not limited thereto. That is, the seed pattern 61 may be formed within a range of modifications thereof that may be utilized by those skilled in the art as long as the seed pattern has a structure of two or more layers including at least one internal interface $S_{if}$ therebetween.

The seed pattern 61 may have an overall thickness $t_{SP}$ of 100 μm or more.

The seed pattern 61 may be formed to have the structure including two or more layers, whereby the exposure limitation based on the thickness of the plating resist may be overcome and the overall thickness $t_{SP}$ of the seed pattern 61 may be provided to be 100 μm or more. Since the seed pattern 61 is formed to have the overall thickness $t_{SP}$ of 100 μm or more, a thickness $t_{IC}$ of each of the first and second internal coil parts 41 and 42 may be increased, and the first and second internal coil parts 41 and 42 having a relatively high aspect ratio (AR) may be provided. In certain embodiments, the two or more seed patterns 61*a*, 61*b* are stacked one on top of the other in a direction perpendicular to the insulating substrate 20, and the two or more seed patterns 61*a*, 61*b* have a same thickness in a direction perpendicular to the opposing surfaces of the insulating substrate 20.

Across section of the seed pattern 61 taken in a thickness direction of the seed pattern 61 may have a rectangular shape.

The seed pattern 61 may be formed by the pattern plating scheme as described above. Accordingly, the cross section of the seed pattern 61 may have an upright rectangular shape.

The first and second internal coil parts 41 and 42 may each further include a thin film conductor layer 25 disposed on a lower surface of the seed pattern 61.

The thin film conductor layer 25 may be formed by performing an electroless plating scheme or a sputtering scheme on the insulating substrate 20 by electroless plating or sputtering on the insulating substrate and then performing etching thereon.

The seed pattern 61 may be formed on the thin film conductor layer 25 by electroplating, using the thin film conductor layer 25 as a seed layer.

The surface plating layer 62 coating the seed pattern 61 may be formed by electroplating, using the seed pattern 61 as a seed layer.

By forming the surface plating layer 62 coating the seed pattern 61, an issue of difficulty in decreasing the interval between the adjacent portions of the coil due to the limitation in decreasing the width of the plating resist when only the seed pattern is formed by pattern plating may be solved, and the cross sectional area of the internal coil part may further be increased to improve DC resistance (Rdc) characteristics and inductance (Ls) characteristics.

The surface plating layer 62 according to the exemplary embodiment of the present inventive concept illustrated in FIG. 3 may have a shape in which the amount of growth $W_{P1}$ of the surface plating layer 62 in a width direction of the surface plating layer 62 and the amount of growth $T_{P1}$ of the surface plating layer 62 in a thickness direction of the surface plating layer 62 are similar to each other.

As such, by forming the surface plating layer 62 coating the seed pattern 61 as an isotropic plating layer of which the amount of growth $W_{P1}$ of the surface plating layer 62 in the width direction of the surface plating layer 62 and the amount of growth $T_{P1}$ of the surface plating layer 62 in the thickness direction of the surface plating layer 62 are similar to each other, a difference in thicknesses of the adjacent portions of the coil may be decreased to allow the internal coil part to have a uniform thickness, whereby DC resistance (Rdc) distribution may be decreased.

In certain embodiments, the thickness ($T_{P1}$) of the surface plating layer on an uppermost surface of the two or more seed pattern layers in the direction perpendicular to the opposing surfaces of the insulating substrate 20 is equal to a thickness ($W_{P1}$) of the surface plating layer along a side surface of the seed pattern layers in direction parallel to the opposing surfaces of the insulating substrate 20.

In addition, the first and second internal coil parts 41 and 42 may not be bent, but may be formed to have upright cross sections, respectively. Short-circuits between the adjacent portions of the coil may be prevented and defects in which the insulating films 30 are not formed on portions of the first and second internal coil parts 41 and 42 may be prevented by forming the surface plating layers 62 as the isotropic plating layers.

Since the seed patterns 61 according to the exemplary embodiment of the present inventive concept are each formed as two or more layers, although the surface plating layers 62 are only formed as the isotropic plating layers on the seed patterns 61 the first and second internal coil parts 41 and 42 having a relatively high aspect ratio (AR) may be provided.

Here, the thickness $t_{SP}$ of the seed pattern 61 may be equal to 70% or more of the overall thickness $t_{IC}$ of each of the first and second internal coil parts 41 and 42 including the thin film conductor layers 25, the seed patterns 61, and the surface plating layers 62, respectively.

Each of the first and second internal coil parts 41 and 42 according to an exemplary embodiment of the present inventive concept formed as described above may have an overall thickness $t_{IC}$ of 150 μm or more, and may have an aspect ratio (AR) of 2.0 or more.

Figure 4:
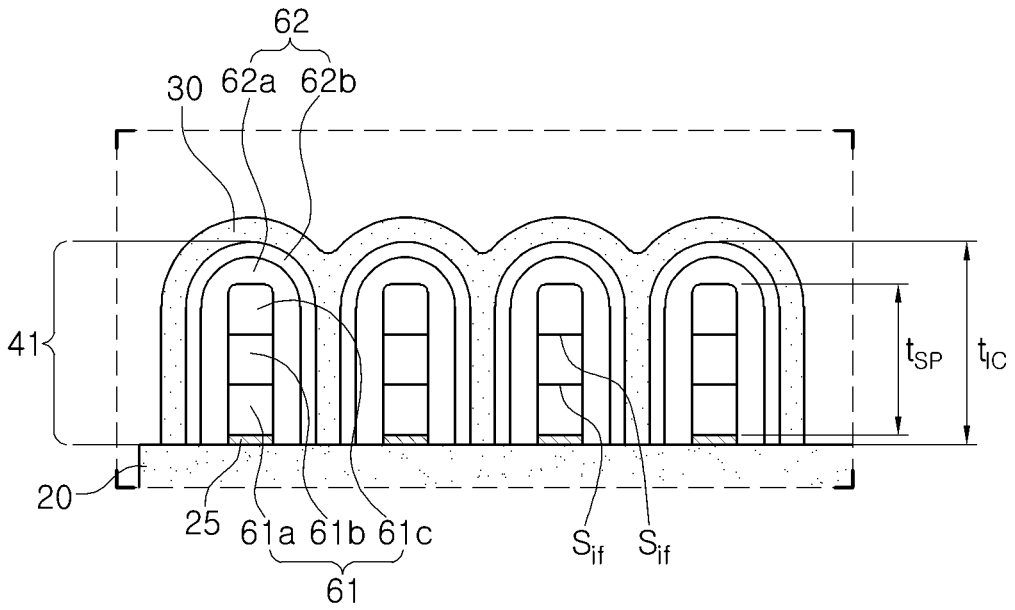
FIGS. 4 through 6 are enlarged schematic views of other exemplary embodiments of portion 'A' of FIG. 2.
Figure 5:
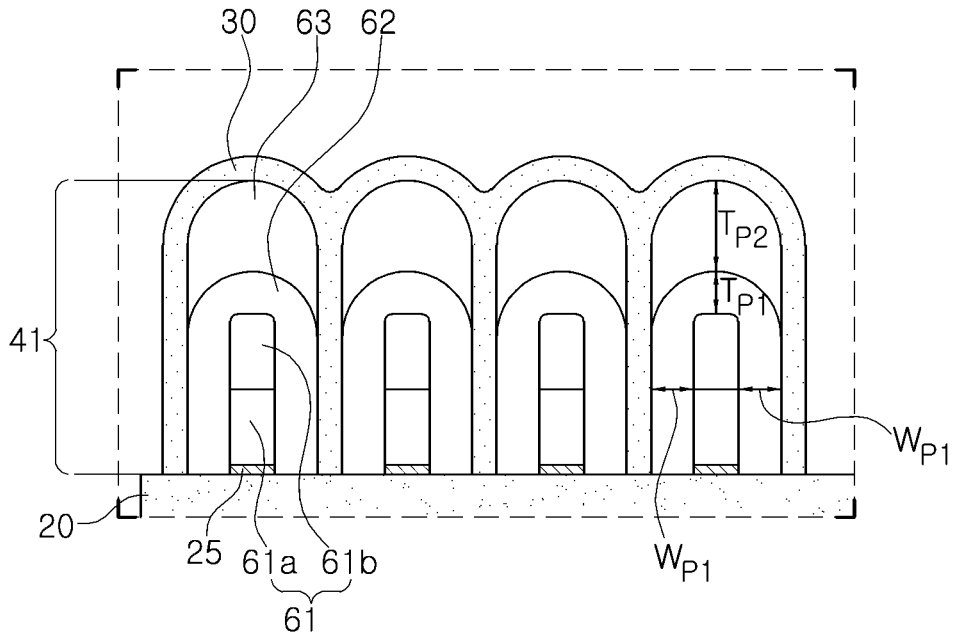
Figure 6:
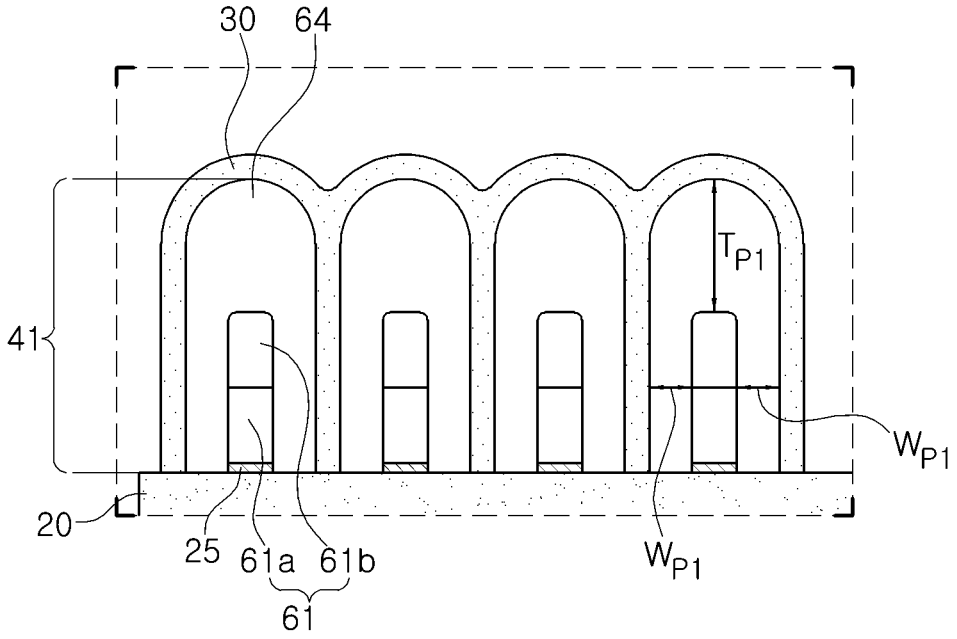

FIGS. 4 through 6 are enlarged schematic views of other exemplary embodiments of portion 'A' of FIG. 2.

Referring to FIG. 4, a seed pattern 61 according to another exemplary embodiment of the present inventive concept may include a first seed pattern 61*a*, a second seed pattern 61*b* formed on an upper surface of the first seed pattern 61*a*, and a third seed pattern 61*c* formed on an upper surface of the second seed pattern 61*b*.

Internal interfaces $S_{if}$ may be formed between the first and second seed patterns 61*a* and 61*b* and between the second and third seed patterns 61*b* and 61*c*, respectively.

As described above, the seed pattern 61 according to other exemplary embodiments of the present inventive concept may be formed within a range of modifications thereof that may be utilized by those skilled in the art as long as the seed pattern 61 has a structure of two or more layers including at least one internal interface $S_{if}$ therebetween.

In addition, FIG. 4 illustrates first and second surface plating layers 62*a* and 62*b* formed as two layers, respectively, according to other exemplary embodiments of the present inventive concept.

The first and second surface plating layers 62*a* and 62*b* may be isotropic plating layers of which the amount of growth $W_{P1}$ in a width direction of the first and second surface plating layers 62*a* and 62*b* and the amount of growth $T_{P1}$ in a thickness direction of the first and second surface plating layers 62*a* and 62*b* are similar to each other, similar to that of the exemplary embodiment illustrated in FIG. 3. The plating layers may have a structure in which the isotropic plating layers are formed as two layers, respectively.

Although the surface plating layer 62 is illustrated as two layers in FIG. 4, the number of layers to be included in the surface plating layer 62 is not limited thereto. That is, the surface plating layer 62 may be formed as two or more layers within a range of modifications thereof that may be utilized by those skilled in the art.

Referring to FIG. 5, an internal coil part 41 according to another exemplary embodiment of the present inventive concept may include a first surface plating layer 62 coating a seed pattern 61 and a second surface plating layer 63 disposed on an upper surface of the first surface plating layer 62. The first and second surface plating layers 62 and 63 may be formed by electroplating.

The first surface plating layer 62 may be an isotropic plating layer having a shape in which the amount of growth $W_{P1}$ of the first surface plating layer 62 in a width direction of the first surface plating layer 62 and the amount of growth $T_{P1}$ of the first surface plating layer 62 in a thickness direction of the first surface plating layer 62 are similar to each other. The second surface plating layer 63 may be an anisotropic plating layer having a shape in which a growth of the second surface plating layer 63 in a width direction of the second surface plating layer 63 is suppressed and growth $T_{P2}$ of the second surface plating layer 63 in a thickness direction of the second surface plating layer 63 is significantly large.

The second surface plating layer 63, the anisotropic plating layer, may be formed on the upper surface of the first surface plating layer 62, and may have a shape in which the second surface plating layer 63 does not coat the entirety of each side surface of the first surface plating layer 62.

In this regard, the internal coil parts 41 and 42 having a relatively high aspect ratio (AR) may be provided and DC resistance (Rdc) characteristics may further be improved by additionally forming the second surface plating layers 63, the anisotropic plating layers, on the first surface plating layers 62, the isotropic plating layers, respectively.

Referring to FIG. 6, a surface plating layer 64 coating a seed pattern 61 according to another exemplary embodiment of the present inventive concept may have a shape in which the amount of growth $T_{P1}$ of the surface plating layer 64 in a thickness direction of the surface plating layer 64 is significantly larger than the amount of growth $W_{P1}$ of the surface plating layer 64 in a width direction of the surface plating layer 64.

As described above, the internal coil parts 41 and 42 capable of preventing short-circuits between the adjacent portions of the coil and having the relatively high aspect ratio (AR) may be provided, by forming the surface plating layers 64 coating the seed patterns 61 as anisotropic plating layers of which the amount of growth $T_{P1}$ of the surface plating layers 64 in the thickness direction of the surface plating layers 64 are significantly larger than the amount of growth $W_{P1}$ of the surface plating layers 64 in the width direction of the surface plating layers 64.

The surface plating layer 64, the anisotropic plating layer, may be formed by adjusting a current density, a concentration of a plating solution, a plating speed, and the like.

Figure 7A:
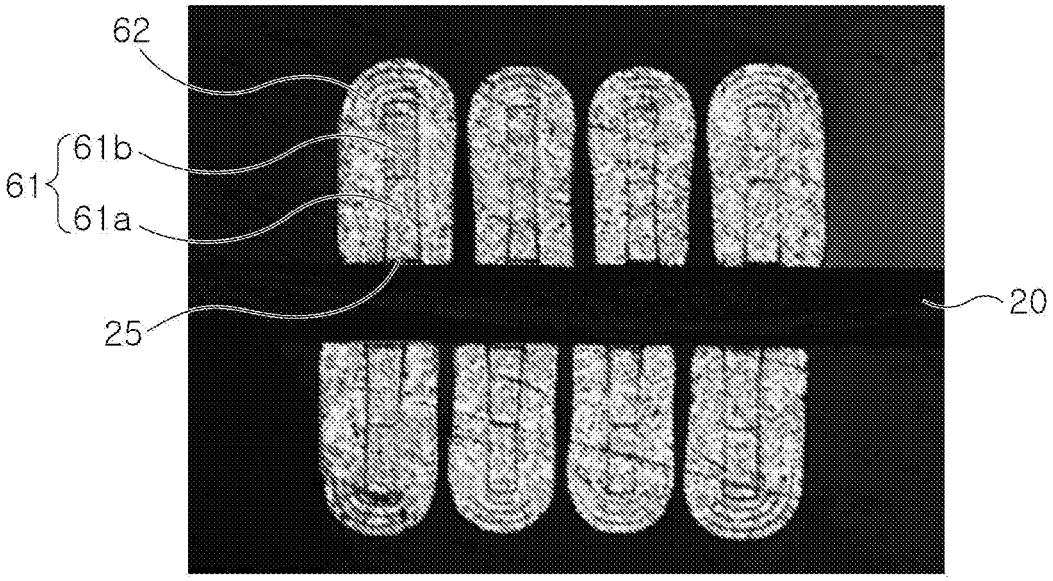
FIGS. 7A and 7B are enlarged portions of scanning electron microscope (SEM) photographs of other exemplary embodiments of portion 'A' of FIG. 2.
Figure 7B:
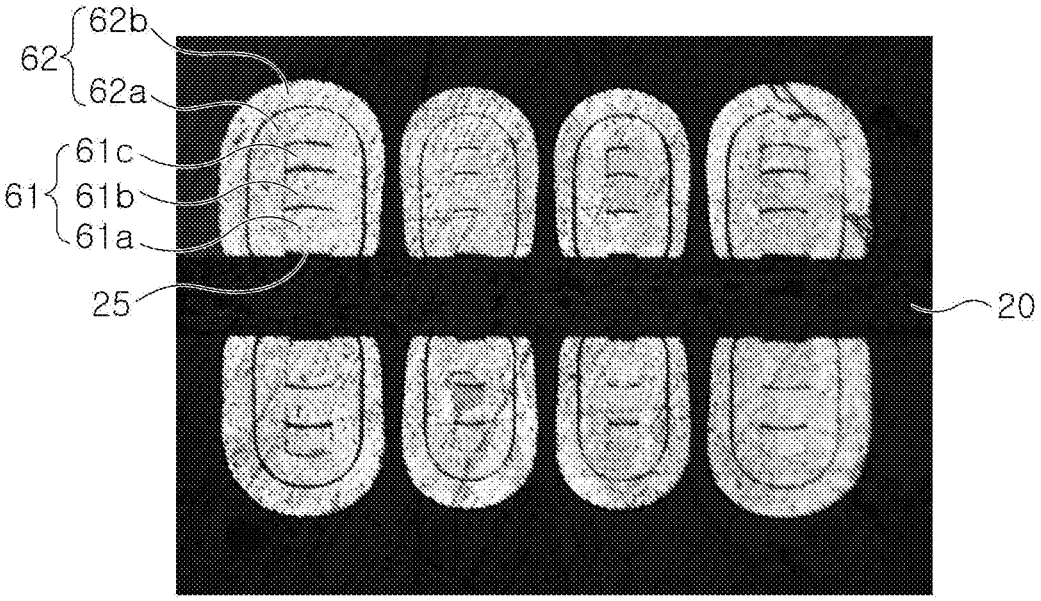

FIGS. 7A and 7B are enlarged portions of scanning electron microscope (SEM) photographs of other exemplary embodiments of portion 'A' of FIG. 2.

Referring to FIG. 7A, the thin film conductor layers 25 formed on the insulating substrate 20, the first seed patterns 61*a* formed on the thin film conductor layers 25, the second seed patterns 61*b* formed on the upper surfaces of the first seed patterns 61*a*, and the surface plating layers 62 each coating the first and second seed patterns 61*a* and 61*b* and having an isotropic plating shape are illustrated.

Referring to FIG. 7B, the thin film conductor layers 25 formed on the insulating substrate 20, the first seed patterns 61*a* formed on the thin film conductor layers 25, the second seed patterns 61*b* formed on the upper surfaces of the first seed patterns 61*a*, the third seed patterns 61*c* formed on the upper surfaces of the second seed patterns 61*b*, and the surface plating layer 62 including two layers and coating the first to third seed patterns 61*a* to 61*c* and having an isotropic plating shape are illustrated.

As described above, according to the exemplary embodiment of the present inventive concept, by forming the structure of the internal coil part including the seed pattern 61 formed as two or more layers and the surface plating layer 62 coating the seed pattern 61, the DC resistance (Rdc) characteristics and inductance (Ls) characteristics may be improved. The internal coil part may have a uniform thickness to thereby decrease the DC resistance (Rdc) distribution. The internal coil part may be formed to have an upright cross section without being bent, whereby short-circuits between the adjacent portions of the coil may be prevented, and defects in which the insulating film 30 is not formed may be prevented.

In another embodiment of the inventive concept, a multilayer seed pattern inductor is provided, including a magnetic body containing a magnetic material. A first internal coil part and a second internal coil part are encapsulated in the magnetic body. The first internal coil part and the second internal coil part are formed on opposing surfaces of an insulating substrate, and each of the first and second internal coil parts comprise two or more seed pattern layers. The two or more seed pattern layers are stacked one on top of the other in a direction perpendicular to the opposing surfaces of the insulating substrate. A surface plating layer is coated on the two or more seed pattern layers. A thickness of the surface plating layer on an uppermost surface of the two or more seed pattern layers in the direction perpendicular to the opposing surfaces of the insulating substrate is equal to a thickness of the surface plating layer along a side surface of the seed pattern layers in direction parallel to the opposing surfaces of the insulating substrate. The first and second external electrodes are disposed on opposing sides of the magnetic body.

In another embodiment of the inventive concept, a multilayer seed pattern inductor is provided including, a magnetic body containing a magnetic material. A first internal coil part and a second internal coil part are encapsulated in the magnetic body. The first internal coil part and the second internal coil part are formed on opposing surfaces of an insulating substrate. Each of the first and second internal coil parts include an opening in a central portion of the internal coil parts and the insulating substrate comprises a through hole corresponding to the openings in the central portions of the internal coil parts. Each of the first and second internal coil parts comprise two or more seed pattern layers. The two or more seed pattern layers are stacked one on top of the other in a direction perpendicular to opposing surfaces of the insulating substrate. A surface plating layer is coated on the two or more seed pattern layers. A thickness of the surface plating layer on an uppermost surface of the two or more seed pattern layers in the direction perpendicular to the opposing surfaces of the insulating substrate is equal to a thickness of the surface plating layer along a side surface of the seed pattern layers in direction parallel to the opposing surfaces of the insulating substrate. A magnetic material fills the openings in the central portions of the internal coil parts and the through hole in the insulating substrate.

Manufacturing Method of Multilayer Seed Pattern Inductor

FIGS. 8A through 8H are views illustrating sequential operations of a manufacturing method of a multilayer seed pattern inductor according to an exemplary embodiment of the present inventive concept.

Figures 8A, 8B, 8C, 8D, 8E, 8F, 8G, 8H:
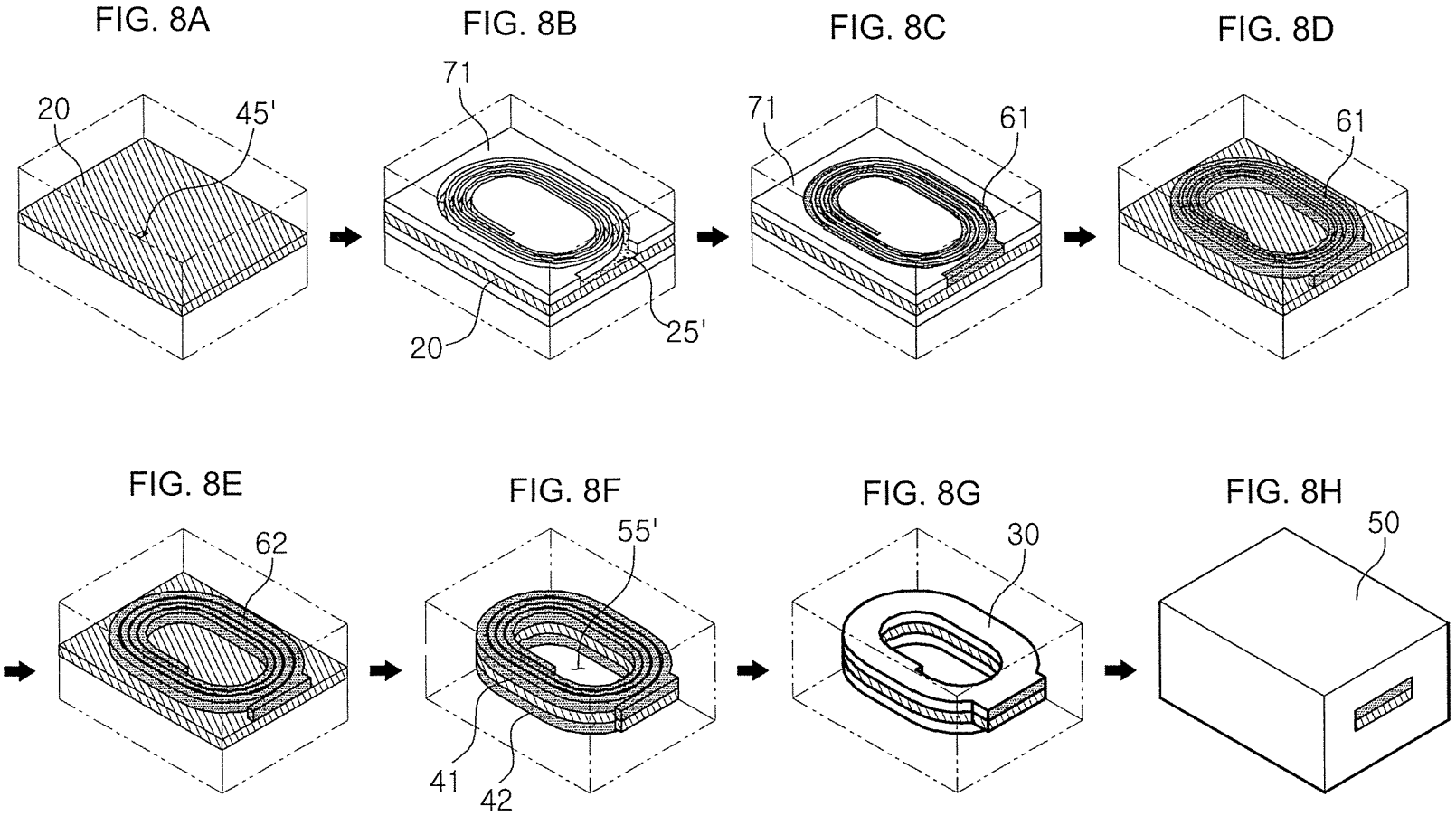
FIGS. 8A through 8H are views illustrating sequential operations of a manufacturing method of a multilayer seed pattern inductor according to an exemplary embodiment of the present inventive concept.

Referring to FIG. 8A, the insulating substrate 20 may be prepared, and a via hole 45' may be formed in the insulating substrate 20. The via hole 45' may be formed using a mechanical drill or a laser drill, but the manner of forming the via hole 45' is not necessarily limited thereto. The laser drill may be, for example, a carbon dioxide ($CO_2$) laser drill or a yttrium aluminum garnet (YAG) laser drill.

Referring to FIG. 8B, a thin film conductor layer 25' may be formed on entire upper and lower surfaces of the insulating substrate 20, and a plating resist 71 having an opening for forming a seed pattern may be formed thereon. The plating resist 71, a general photosensitive resist film, may be a dry film resist, or the like, but the type of the plating resist 71 is not necessarily limited thereto.

In detail, subsequent to the plating resist 71 being applied onto the thin film conductor layer 25', the opening for forming the seed pattern may be formed by an exposure and development processes.

Referring to FIG. 8C, the opening for forming the seed pattern may be filled with a conductive metal by plating to form the seed pattern 61. In detail, the seed pattern 61 may be formed by using the thin film conductor layer 25' as a seed layer and filling the opening for forming the seed pattern with the conductive metal by electroplating. The via 45 may be formed by filling the via hole 45' with the conductive metal by electroplating.

Here, in an exemplary embodiment of the present inventive concept, the seed pattern 61 may be formed as two or more layers to allow the internal coil parts 41 and 42 to have a relatively high aspect ratio (AR). A detailed description pertaining to a manufacturing method of the seed pattern 61 will be provided below.

Referring to FIG. 8D, the plating resist 71 may be removed, and the thin film conductor layer 25' may be etched to form the thin film conductor layer 25 only on the lower surface of the seed pattern 61.

Referring to FIG. 8E, the surface plating layer 62 coating the seed pattern 61 may be formed. The surface plating layer 62 may be formed by electroplating using the seed pattern 61 as a seed layer.

By forming the surface plating layer 62 coating the seed pattern 61, the issue of difficulties introduced by decreasing the interval between the adjacent portions of the coil due to limitations in decreasing the width of the plating resist when forming only the seed pattern by the pattern plating scheme may be solved. The cross sectional area of the internal coil part may further be increased to thereby improve DC resistance (Rdc) characteristics and inductance (Ls) characteristics.

Referring to FIG. 8F, portions of the insulating substrate 20 aside from portions of the insulating substrate 20 on which the first and second internal coil parts 41 and 42 including the seed patterns 61 and the surface plating layers 62 are formed may be removed. A central portion of the insulating substrate 20 may be removed, such that a core part hole 55' may be formed therein. The insulating substrate 20 may be removed by mechanical drilling, laser drilling, sand blasting, punching, or the like.

Referring to FIG. 8G, the insulating films 30 coating the first and second internal coil parts 41 and 42 may be formed, respectively. The insulating film 30 may be formed by a scheme well-known in the art such as a screen printing process, exposure and development processes for a photoresist (PR), a spray application process, or the like.

Referring to FIG. 8H, magnetic sheets may be stacked above and below the insulating substrate 20 on which the first and second internal coil parts 41 and 42 are formed. The magnetic sheets may be compressed and may be hardened to form the magnetic body 50. Here, the core part hole 55' may be filled with magnetic materials to form the core part 55. The first and second external electrodes 81 and 82 may be formed on the outer surfaces of the magnetic body 50 and connected to the end portions of the first and second internal coil parts 41 and 42 exposed to the end surfaces of the magnetic body 50, respectively.

FIGS. 9A through 9F are views illustrating sequential processes of forming a seed pattern according to an exemplary embodiment of the present inventive concept.

Figure 9A:
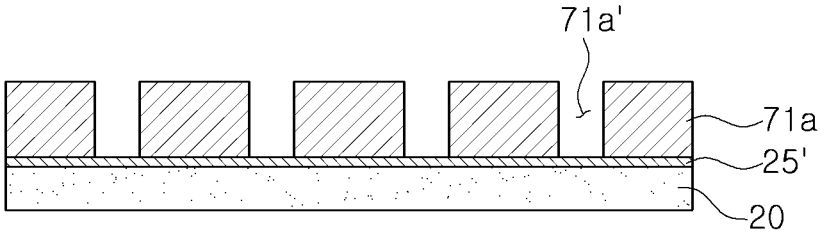
FIGS. 9A through 9F are views illustrating sequential processes of forming a seed pattern according to an exemplary embodiment of the present inventive concept.

Referring to FIG. 9A, a first plating resist 71*a* having an opening 71*a'* for forming a first seed pattern may be formed on the insulating substrate 20 on which the thin film conductor layer 25' is formed.

In detail, subsequent to the first plating resist 71*a* being applied onto the thin film conductor layer 25', the opening 71*a'* for forming the first seed pattern may be formed by an exposure and development processes. A thickness of the first plating resist 71*a* may be in a range of about 40 to 60 μm.

Figure 9B:
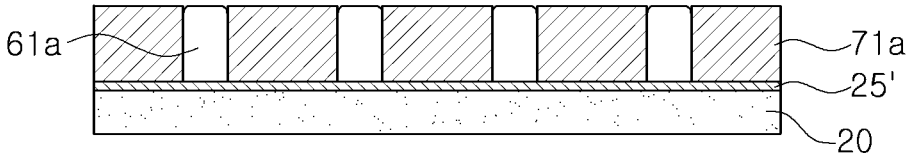

Referring to FIG. 9B, the opening 71*a'* for forming the first seed pattern may be filled with a conductive metal by plating to thereby form the first seed pattern 61*a*.

Figure 9C:
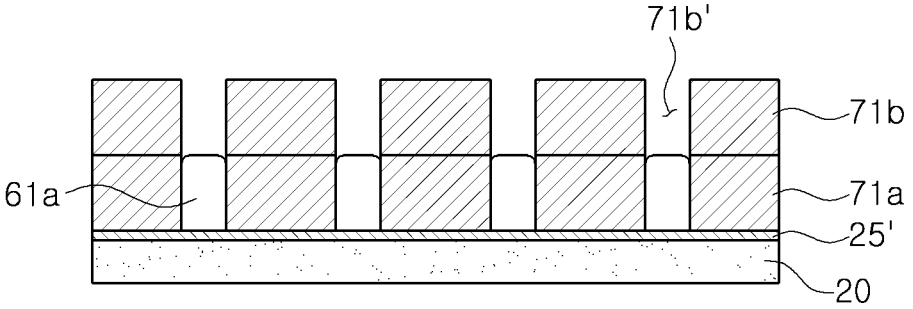

Referring to FIG. 9C, a second plating resist 71*b* having an opening 71*b'* for forming a second seed pattern may be formed on the first plating resist 71*a*. In detail, subsequent to the second plating resist 71*b* being applied onto the first plating resist 71*a* and the first seed patterns 61*a*, the opening 71*b'* for forming the second seed pattern exposing the first seed pattern 61*a* may be formed by exposure and development processes. A thickness of the second plating resist 71*b* may be in a range of about 40 to 60 μm.

Figure 9D:
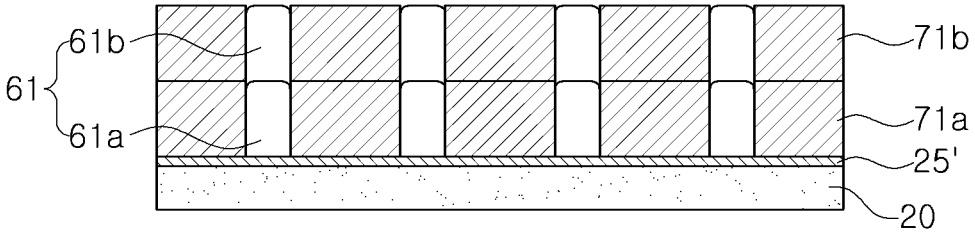

Referring to FIG. 9D, the opening 71*b'* for forming the second seed pattern may be filled with a conductive metal by plating to thereby form the second seed pattern 61*b* on the upper surface of the first seed pattern 61*a*.

Figure 9E:
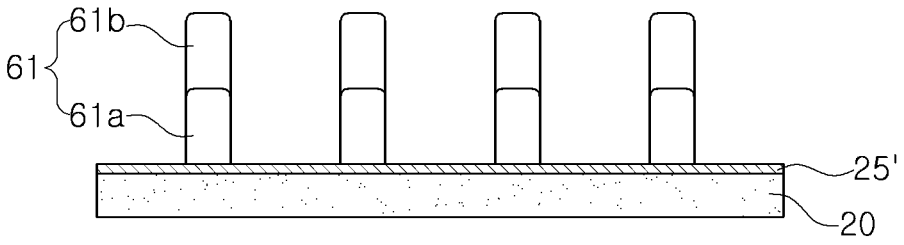

Referring to FIG. 9E, the first and second plating resists 71*a* and 71*b* may be removed.

Figure 9F:
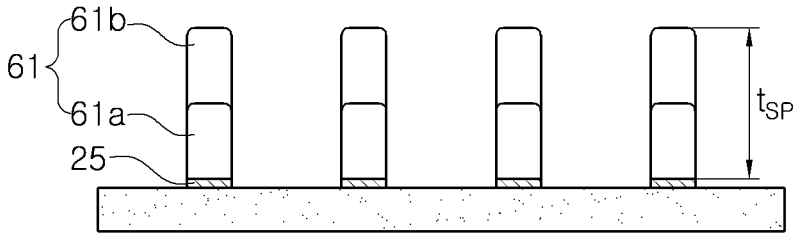

Referring to FIG. 9F, the thin film conductor layer 25' may be etched to form the thin film conductor layer 25 only on the lower surface of the seed pattern 61.

The seed pattern 61 formed as described above may have a two-layer structure including an internal interface $S_{if}$ therebetween. A cross section of the seed pattern 61 taken in the thickness T direction of the seed pattern 61 may have a rectangular shape, and the overall thickness $t_{SP}$ of the seed pattern 61 may be 100 μm or more.

Meanwhile, although the processes of only forming the first and second seed patterns 61*a* and 61*b* are illustrated in FIGS. 9A through 9F, the type of structure of the seed pattern is not necessarily limited thereto. That is, the processes described above with reference to FIGS. 9C and 9D may be reiteratively performed, whereby a seed pattern having a structure of two or more layers including at least one internal interface $S_{if}$ therebetween may be formed.

FIGS. 10A through 10D are views illustrating sequential processes of forming a seed pattern according to another exemplary embodiment of the present inventive concept.

Figure 10A:
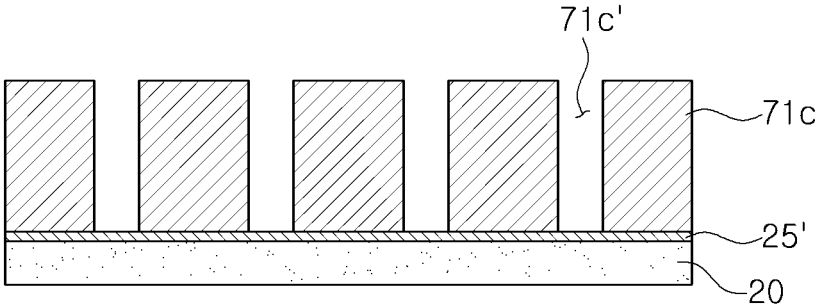
FIGS. 10A through 10D are views illustrating sequential processes of forming a seed pattern according to another exemplary embodiment of the present inventive concept.

Referring to FIG. 10A, a third plating resist 71*c* having an opening 71*c'* for forming first and second seed patterns may be formed on the insulating substrate 20 on which the thin film conductor layer 25' is formed. In detail, subsequent to the third plating resist 71*c* being applied onto the thin film conductor layer 25', the opening 71*c'* for forming the first and second seed patterns may be formed by an exposure and development processes. A thickness of the third plating resist 71*c* may be in a range of about 80 to 130 μm.

Figure 10B:
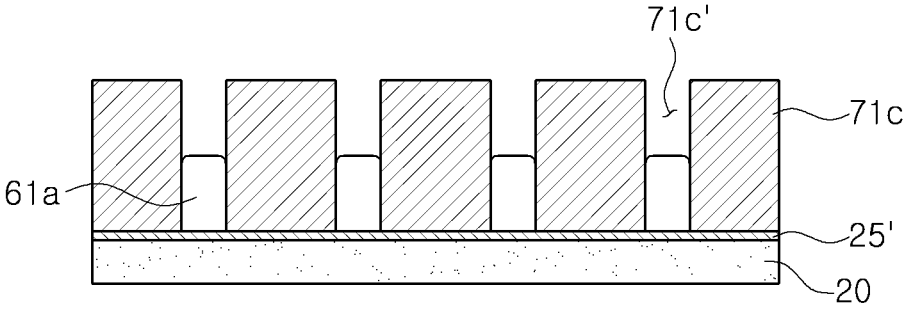

Referring to FIG. 10B, the opening 71*c'* for forming the first and second seed patterns may be primarily filled with a conductive metal by plating to thereby form the first seed pattern 61*a*.

Figure 10C:
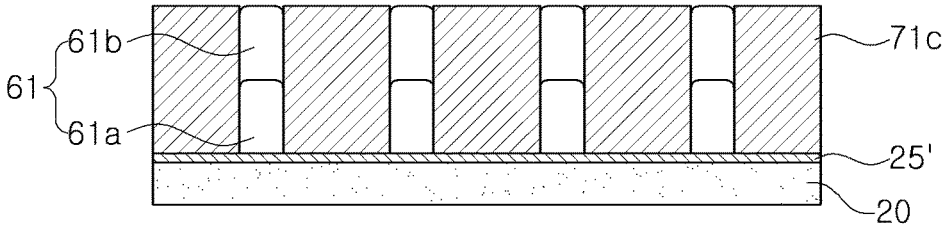

Referring to FIG. 10C, the opening 71*c'* for forming the first and second seed patterns may be secondarily filled with a conductive metal by plating to thereby form the second seed pattern 61*b* on the upper surface of the first seed pattern 61*a*.

Figure 10D:
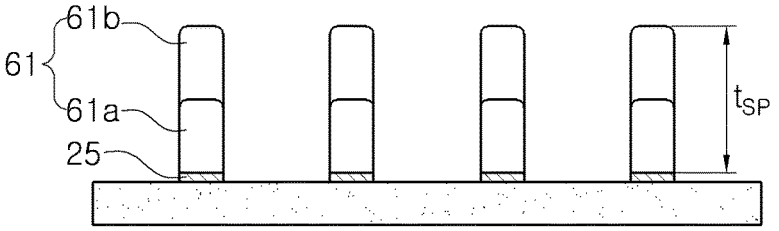

Referring to FIG. 10D, the third plating resist 71*c* may be removed, and the thin film conductor layer 25' may be etched to form the thin film conductor layer 25 only on the lower surface of the seed pattern 61.

The seed pattern 61 formed as described above may have a two-layer structure including an internal interface $S_{if}$ therebetween. The cross section of the seed pattern 61 taken in the thickness T direction of the seed pattern 61 may have a rectangular shape, and the overall thickness $t_{SP}$ of the seed pattern 61 may be 100 μm or more.

Meanwhile, although the processes of only forming the first and second seed patterns 61*a* and 61*b* are illustrated in FIGS. 10A through 10D, the type of structure of the seed pattern is not necessarily limited thereto. That is, the thickness of the third plating resist 71*c* may be increased and the plating process may be performed two or more times, whereby a seed pattern having a structure of two or more layers including at least one internal interface $S_{if}$ therebetween may be formed.

However, due to limitations in the exposure process in which exposure of the lower portion of the plating resist is not smoothly performed as the thickness of the third plating resist 71*c* is increased, the seed pattern may be formed according to the present exemplary embodiment within a range of modifications thereof that may be utilized by those skilled in the art.

Figure 11:
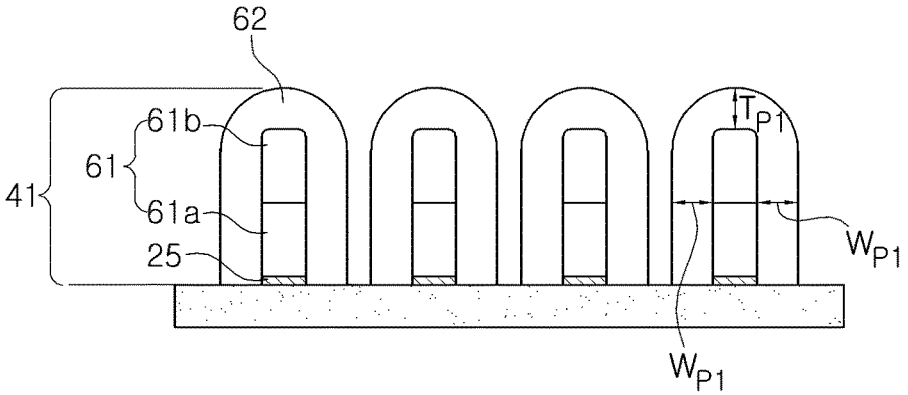
FIG. 11 is a view illustrating a process of forming a surface plating layer according to an exemplary embodiment of the present inventive concept.

FIG. 11 is a view illustrating a process of forming a surface plating layer according to an exemplary embodiment of the present inventive concept. Referring to FIG. 11, an electroplating process may be performed based on the seed pattern 61 to form the surface plating layer 62 coating the seed pattern 61 thereon. A current density, a concentration of a plating solution, a plating speed, and the like, may be adjusted at the time of performing the electroplating process to thereby form the surface plating layer 62 according to an exemplary embodiment of the present inventive concept. The isotropic plating layer of which the amount of growth $W_{P1}$ of the surface plating layer 62 in the width direction of the surface plating layer 62 and the amount of growth $T_{P1}$ of the surface plating layer 62 in the thickness direction of the surface plating layer 62 are similar to each other, as illustrated in FIG. 11.

By forming the surface plating layer 62 coating the seed pattern 61 as the isotropic plating layer of which the amount of growth $W_{P1}$ of the surface plating layer 62 in the width direction of the surface plating layer 62 and the amount of growth $T_{P1}$ of the surface plating layer 62 in the thickness direction of the surface plating layer 62 are similar to each other, as described above, the difference in the thicknesses of the adjacent portions of the coil may be decreased to allow the internal coil part to have a uniform thickness, whereby DC resistance (Rdc) distribution may be decreased.

In addition, by forming the surface plating layers 62 as the isotropic plating layers, respectively, the internal coil parts 41 and 42 may be formed to have upright cross sections without being bent, whereby short-circuits between the adjacent portions of the coil may be prevented and defects in which the insulating films 30 are not formed on portions of the internal coil parts 41 and 42, respectively, may be prevented.

Meanwhile, although the process of only forming the surface plating layer 62 coating the seed pattern 61 by an isotropic plating process is illustrated in FIG. 11, the type of surface plating layer is not necessarily limited thereto. That is, current density, concentration of a plating solution, plating speed, and the like, may be adjusted at the time of performing the electroplating process to form the surface plating layer coating the seed pattern 61 by an anisotropic plating process in which the amount of growth $T_{P1}$ of the surface plating layer in the thickness direction of the surface plating layer is significantly larger than the amount of growth $W_{P1}$ of the surface plating layer in the width direction of the surface plating layer.

Figure 12:
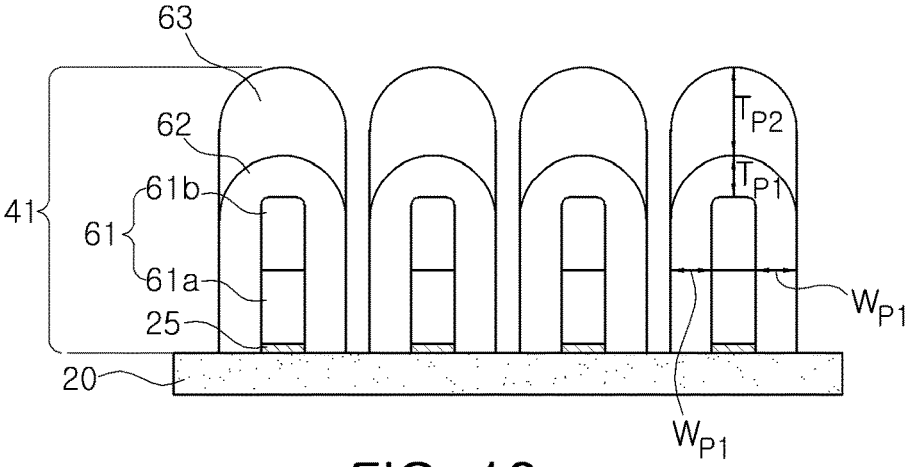
FIG. 12 is a view illustrating a process of forming a surface plating layer according to another exemplary embodiment of the present inventive concept.

FIG. 12 is a view illustrating a process of forming a surface plating layer according to another exemplary embodiment of the present inventive concept. Referring to FIG. 12, an electroplating process may be performed based on the seed pattern 61 to form the first surface plating layer 62 coating the seed pattern 61 thereon, and the electroplating process may be performed on the first surface plating layer 62 to further form the second surface plating layer 63.

When performing the electroplating process, current density, concentration of a plating solution, plating speed, and the like, may be adjusted to thereby form the first surface plating layer 62 as an isotropic plating layer having a shape in which the amount of growth $W_{P1}$ of the first surface plating layer 62 in the width direction of the first surface plating layer 62 and the amount of growth $T_{P1}$ of the first surface plating layer 62 in the thickness direction of the first surface plating layer 62 are similar to each other. The second surface plating layer 63 is formed as an anisotropic plating layer having a shape in which the growth of the second surface plating layer 63 in the width direction of the second surface plating layer 63 is suppressed and the growth $T_{P2}$ of the second surface plating layer 63 in the thickness direction of the second surface plating layer 63 is significantly enlarged.

In this regards, the internal coil parts 41 and 42 having a relatively high aspect ratio (AR) may be provided and DC resistance (Rdc) characteristics may further be improved by additionally forming the second surface plating layers 63, the anisotropic plating layers, on the first surface plating layers 62, the isotropic plating layers.

Figure 13:
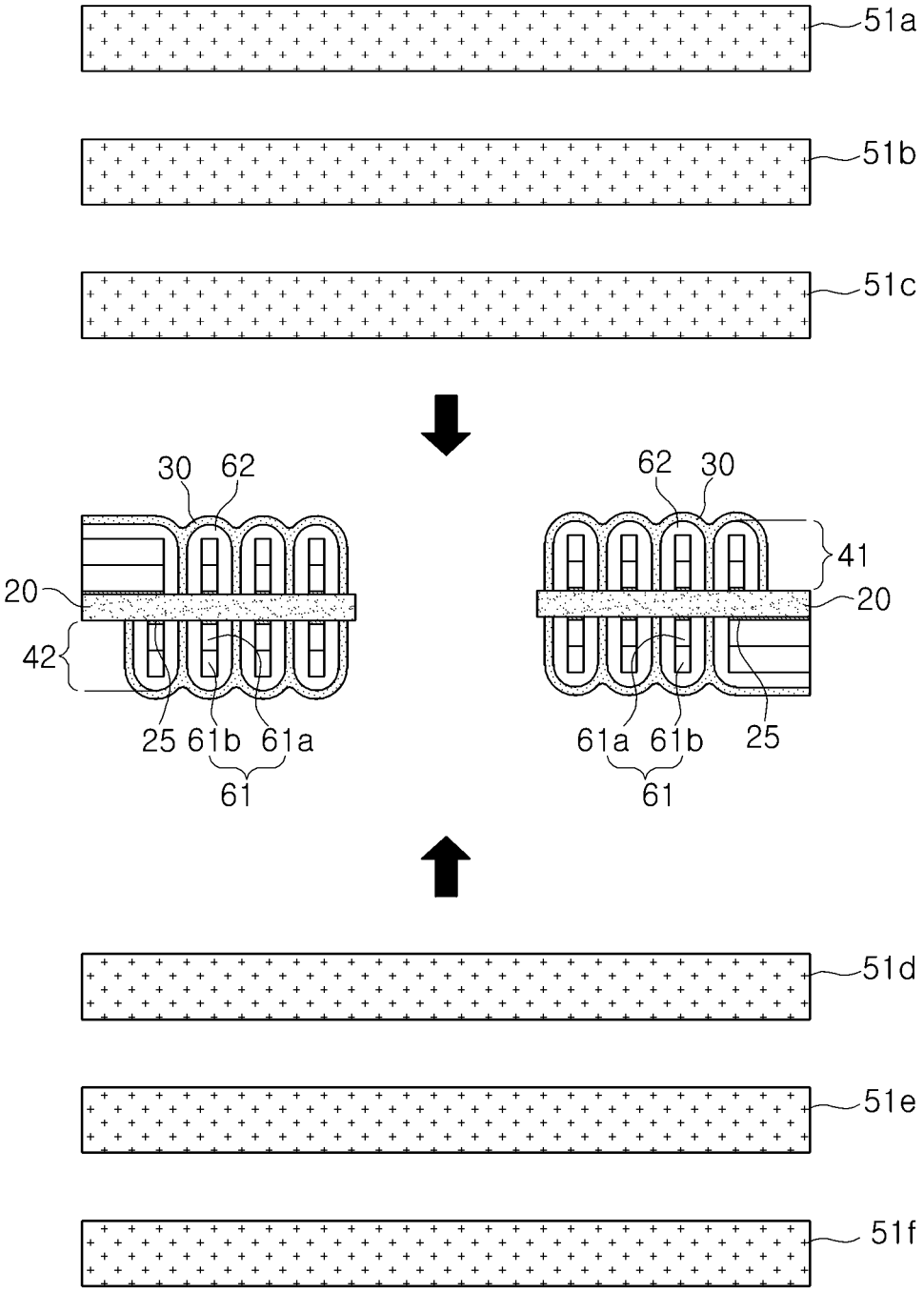
FIG. 13 is a view illustrating a process of forming a magnetic body according to an exemplary embodiment of the present inventive concept.

FIG. 13 is a view illustrating a process of forming a magnetic body according to an exemplary embodiment of the present inventive concept. Referring to FIG. 13, magnetic sheets 51*a* to 51*f* may be stacked above and below the insulating substrate 20 on which the first and second internal coil parts 41 and 42 are formed. The magnetic sheets 51*a* to 51*f* may be manufactured by preparing a slurry using a mixture of a magnetic material, for example, magnetic metal powder and an organic material such as a thermosetting resin, or the like, applying the slurry onto carrier films by a doctor blade scheme, and drying the slurry.

A plurality of magnetic sheets 51*a* to 51*f* may be stacked, compressed by a laminate scheme or an isostatic press scheme, and hardened to form the magnetic body 50.

Except for the above-mentioned description, a description of characteristics identical to those of the multilayer seed pattern inductor according to an exemplary embodiment of the present inventive concept described above will be omitted herein for conciseness.

Board Having Multilayer Seed Pattern Inductor

Figure 14:
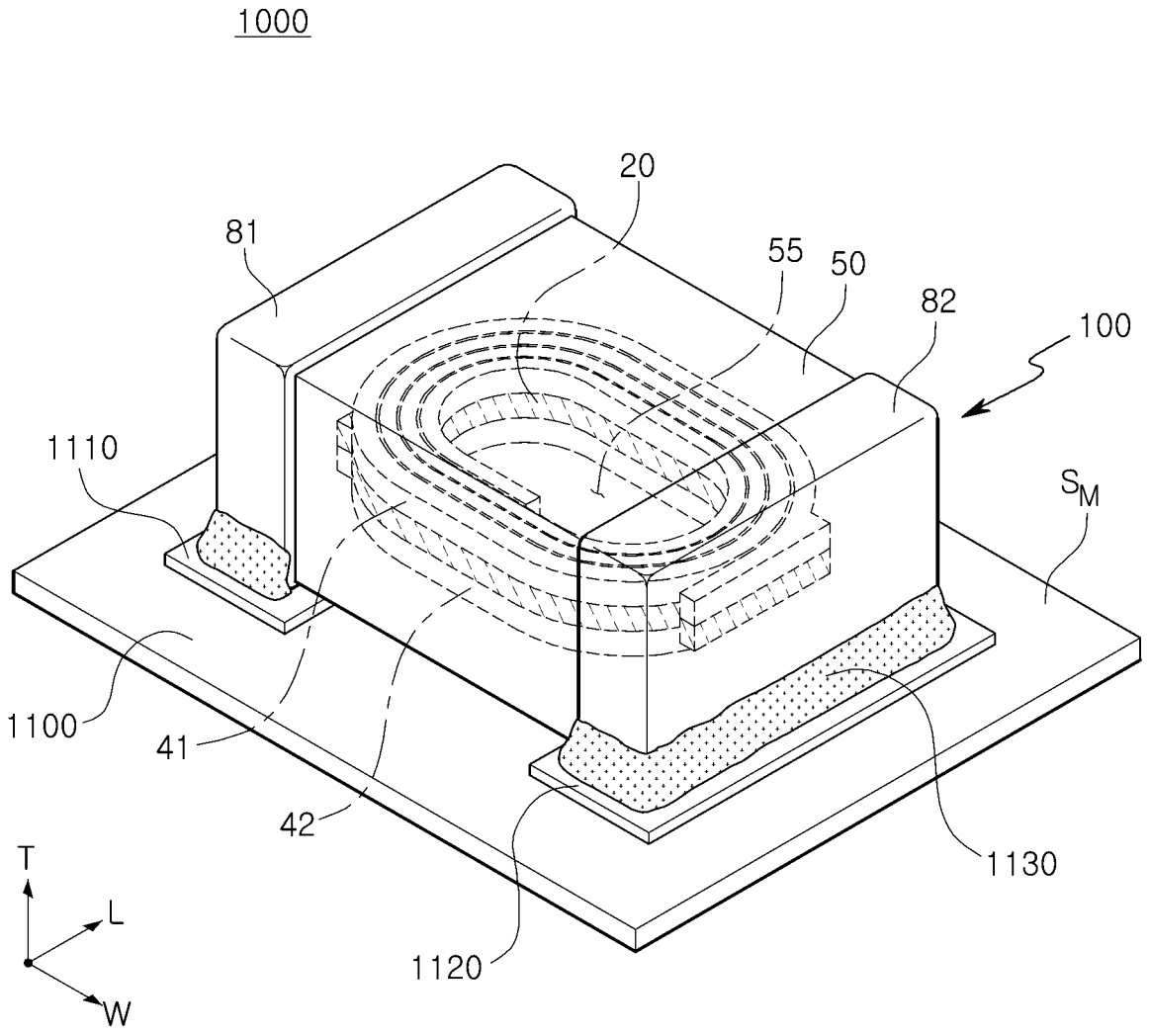
FIG. 14 is a perspective view illustrating a manner in which the multilayer seed pattern inductor of FIG. 1 is mounted on a printed circuit board (PCB).

FIG. 14 is a perspective view illustrating a form in which the multilayer seed pattern inductor of FIG. 1 is mounted on a printed circuit board (PCB). A board 1000 having the multilayer seed pattern inductor 100 according to an exemplary embodiment of the present inventive concept may include a PCB 1100 on which the multilayer seed pattern inductor 100 is mounted and first and second electrode pads 1110 and 1120 formed on an upper surface of the PCB 1100 spaced apart from each other.

The multilayer seed pattern inductor 100 may be electrically connected to the PCB 1100 by solder 1130 where the first and second external electrodes 81 and 82 formed on both end surfaces of the multilayer seed pattern inductor 100 are positioned on the first and second electrode pads 1110 and 1120, respectively, to be in contact with the first and second electrode pads 1110 and 1120, respectively.

The first and second internal coil parts 41 and 42 of the multilayer seed pattern inductor 100 mounted on the PCB 1100 may be disposed to be parallel with respect to a mounting surface ($S_M$) of the PCB 1100.

Figure 15:
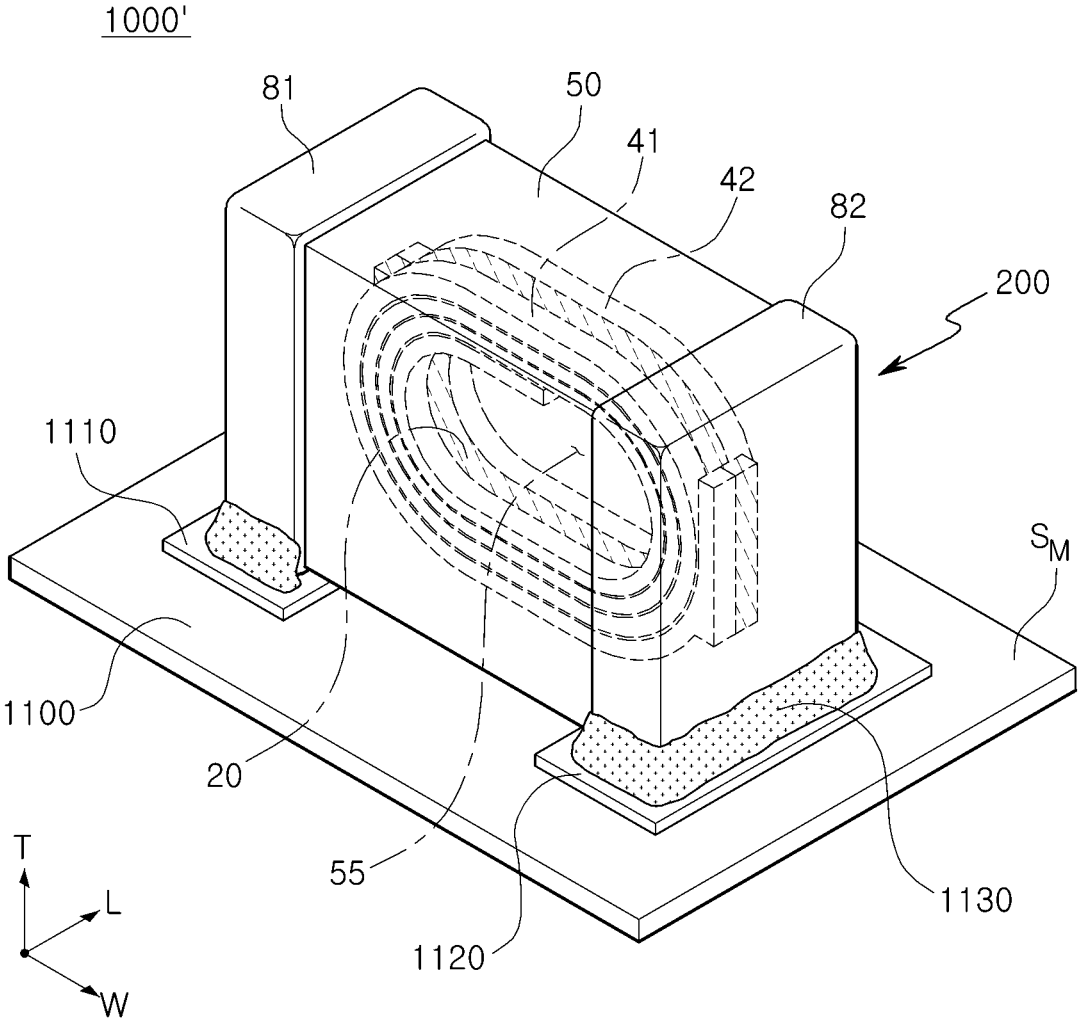
FIG. 15 is a perspective view illustrating a manner in which a multilayer seed pattern inductor according to another exemplary embodiment of the present inventive concept is mounted on a PCB.

FIG. 15 is a perspective view illustrating a form in which a multilayer seed pattern inductor according to another exemplary embodiment of the present inventive concept is mounted on a PCB. Referring to FIG. 15, on a board 1000' having a multilayer seed pattern inductor 200 according to another exemplary embodiment of the present inventive concept, internal coil parts 41 and 42 of the multilayer seed pattern inductor 200 mounted on a PCB 1100 may be disposed to be perpendicular with respect to a mounting surface ($S_M$) of the PCB 1100.

Except for the above-mentioned description, a description of characteristics identical to those of the multilayer seed pattern inductor according to the exemplary embodiment of the present inventive concept described above will be omitted herein for conciseness.

As set forth above, according to exemplary embodiments of the present inventive concept, the cross-sectional area of the internal coil part may be increased, and the DC resistance (Rdc) characteristics may be improved.

While exemplary embodiments have been shown and described above, it will be apparent to those skilled in the art that modifications and variations could be made without departing from the scope of the present invention as defined by the appended claims.

What is claimed is:

1. A multilayer seed pattern inductor comprising:

a magnetic body containing a magnetic material;

an insulating substrate disposed in the magnetic body; and an internal coil part disposed on one surface of the insulating substrate and encapsulated in the magnetic body, wherein the internal coil part includes a seed pattern, a thin film conductor layer disposed between the seed pattern and the insulating substrate, and a surface plating layer disposed on the seed pattern, wherein the seed pattern comprises two or more layers, one layer of the seed pattern being disposed between the remaining of the two or more layers of the seed pattern and the thin film conductor layer, and wherein each of the two or more layers of the seed pattern is in contact with the surface plating layer and is embedded in the surface plating layer.

2. The multilayer seed pattern inductor of claim 1, wherein the two or more layers of the seed pattern include a first seed pattern layer and a second seed pattern layer disposed on an upper surface of the first seed pattern.

3. The multilayer seed pattern inductor of claim 1, wherein an overall thickness of the seed pattern is at least 100 micrometers (μm).

4. The multilayer seed pattern inductor of claim 1, wherein a thickness of the seed pattern is equal to 70% or more of an overall thickness of the internal coil part.

5. The multilayer seed pattern inductor of claim 1, wherein a cross section of the seed pattern taken in a thickness direction of the seed pattern has a rectangular shape.

6. The multilayer seed pattern inductor of claim 1, wherein the surface plating layer has a shape corresponding to the surface plating layer being grown in a width direction of the surface plating layer and a thickness direction of the surface plating layer.

7. The multilayer seed pattern inductor of claim 1, wherein the magnetic body contains magnetic metal powder and a thermosetting resin.

8. The multilayer seed pattern inductor of claim 1, wherein the surface plating layer comprises a plurality of layers.

9. The multilayer seed pattern inductor of claim 1, wherein a thickness of the surface plating layer on an uppermost surface of the two or more seed pattern layers in the direction perpendicular to the one surface of the insulating substrate is equal to a thickness of the surface plating layer along a side surface of the seed pattern layers in direction parallel to the one surface of the insulating substrate.

10. The multilayer seed pattern inductor of claim 1, wherein a thickness of the surface plating layer on an uppermost surface of the two or more seed pattern layers in the direction perpendicular to the one surface of the insulating substrate is greater than a thickness of the surface plating layer along a side surface of the seed pattern layers in direction parallel to the one surface of the insulating substrate.

11. A multilayer seed pattern inductor comprising:

a magnetic body containing a magnetic material;

a first internal coil part and a second internal coil part encapsulated in the magnetic body, wherein the first internal coil part and the second internal coil part are disposed on opposing surfaces of an insulating substrate, each of the first and second internal coil parts comprises two or more seed pattern layers and a thin film conductor layer disposed between the insulating substrate and the two or more seed pattern layers thereof, and the two or more seed pattern layers are stacked one on top of the other in a direction perpendicular to the opposing surfaces of the insulating substrate;

a surface plating layer being in contact with each of the two or more seed pattern layer and embedding the two or more seed pattern layers, wherein a thickness of the surface plating layer on an uppermost surface of the two or more seed pattern layers in the direction perpendicular to the opposing surfaces of the insulating substrate is equal to or greater than a thickness of the surface plating layer along a side surface of the seed pattern layers in direction parallel to the opposing surfaces of the insulating substrate; and first and second external electrodes disposed on opposing sides of the magnetic body.

12. The multilayer seed pattern inductor of claim 11, wherein the first internal coil part is in direct, physical contact with the first external electrode, and the second internal coil part is in direct, physical contact with the second external electrode.

13. The multilayer seed pattern inductor of claim 11, wherein a cross section of the two or more seed pattern layers taken in a thickness direction of the seed pattern layers has a rectangular shape.

14. The multilayer seed pattern inductor of claim 11, wherein the surface plating layer comprises a plurality of layers.

15. A multilayer seed pattern inductor comprising:

a magnetic body containing a magnetic material;

an insulating substrate disposed in the magnetic body; and an internal coil part disposed on one side of the insulating substrate and encapsulated in the magnetic body, wherein the internal coil part includes a seed pattern and a surface plating layer disposed on the seed pattern, wherein the seed pattern comprises two or more layers, and wherein each of the two or more layers of the seed pattern has a width smaller than a thickness thereof, is in contact with the first surface plating layer, and is embedded in the first plating layer.

16. The multilayer seed pattern inductor of claim 15, wherein an overall thickness of the seed pattern is at least 100 micrometers (μm).

17. The multilayer seed pattern inductor of claim 15, wherein a thickness of the seed pattern is equal to 70% or more of an overall thickness of the internal coil part.

18. The multilayer seed pattern inductor of claim 15, wherein a cross section of the seed pattern taken in a thickness direction of the seed pattern has a rectangular shape.

19. The multilayer seed pattern inductor of claim 15, wherein the magnetic body contains magnetic metal powder and a thermosetting resin.

20. The multilayer seed pattern inductor of claim 15, wherein the surface plating layer comprises a plurality of layers.

* * * * *